US010093447B2

(12) United States Patent
Shimizu

(10) Patent No.: US 10,093,447 B2
(45) Date of Patent: Oct. 9, 2018

(54) PACKING BOX

(71) Applicant: RIKEN TECHNOS CORPORATION, Tokyo (JP)

(72) Inventor: Motohiro Shimizu, Tokyo (JP)

(73) Assignee: RIKEN TECHNOS CORPORATION (JP)

( * ) Notice: Subject to any disclaimer, the term of this patent is extended or adjusted under 35 U.S.C. 154(b) by 0 days.

(21) Appl. No.: 15/118,647

(22) PCT Filed: Jan. 26, 2015

(86) PCT No.: PCT/JP2015/052001

§ 371 (c)(1),
(2) Date: Aug. 12, 2016

(87) PCT Pub. No.: WO2015/122263

PCT Pub. Date: Aug. 20, 2015

(65) Prior Publication Data

US 2017/0050759 A1 Feb. 23, 2017

(30) Foreign Application Priority Data

Feb. 14, 2014 (JP) ..... 2014-026283

(51) Int. Cl.
*B65D 5/64* (2006.01)
*B65D 5/22* (2006.01)
(Continued)

(52) U.S. Cl.
CPC ..... *B65D 5/64* (2013.01); *B65D 5/22* (2013.01); *B65D 5/4208* (2013.01); *B65D 5/68* (2013.01);
(Continued)

(58) Field of Classification Search
CPC ..... B65D 5/64; B65D 5/22; B65D 5/4208; B65D 83/0841; B65D 85/672; B65D 5/68; B65D 2571/00444
(Continued)

(56) References Cited

U.S. PATENT DOCUMENTS 2,474,783 A * 6/1949 Gluck ..... B65D 83/0882 225/50
6,708,874 B1 3/2004 Montgomery
(Continued)

FOREIGN PATENT DOCUMENTS

JP S1210060 Y 7/1937
JP S52171526 U 12/1977
(Continued)

OTHER PUBLICATIONS

PCT/JP2015/052001 International Search Report dated Apr. 21, 2015; 3 pgs.
JP2015-527701 Office Action dated Nov. 12, 2015; 10 pgs.

*Primary Examiner* — Christopher Demeree
(74) *Attorney, Agent, or Firm* — Bracewell LLP; Brad Y. Chin

(57) ABSTRACT

Embodiments of the invention provide a packing box wherein strength is improved and efficiency of opening, content retrieval, etc. is improved. Embodiments of the invention provide a packing box obtained from an upper cover and a lower box configured from cardboard for accommodating articles therein, in which: the upper cover is obtained from a top board that covers the entire interior of the lower box and side boards that extend vertically downward from each side of the top board and substantially cover the side surfaces of the lower box; and at least one notch is provided on one of the lower edges of the upper cover.

12 Claims, 12 Drawing Sheets

(51) Int. Cl.
*B65D 85/672* (2006.01)
*B65D 5/68* (2006.01)
*B65D 5/42* (2006.01)
*B65D 83/08* (2006.01)

(52) U.S. Cl.
CPC ..... *B65D 83/0841* (2013.01); *B65D 85/672* (2013.01)

(58) Field of Classification Search
USPC ..... 229/125.19, 117.16, 164, 122.32, 160.2, 229/129; 206/815
See application file for complete search history.

(56) References Cited

U.S. PATENT DOCUMENTS 7,780,067 B2 * 8/2010 Holley, Jr. ..... B65D 5/0227 229/117.12
7,798,391 B2 * 9/2010 Tibbels ..... B65D 5/16 229/125.19
8,991,686 B2 * 3/2015 Schultz ..... B65D 83/0876 220/62
9,051,075 B2 * 6/2015 Scott ..... B65D 5/6667
2012/0267385 A1 10/2012 Scott

FOREIGN PATENT DOCUMENTS

| | | | |
|---|---|---|---|
| JP | S59-30826 | U | 2/1984 |
| JP | S63-49316 | U | 4/1988 |
| JP | H0185220 | U | 6/1989 |
| JP | H11115930 | A | 4/1999 |
| JP | 3059671 | U | 7/1999 |
| JP | 2000238742 | A | 9/2000 |
| JP | 2002037240 | A | 2/2002 |
| JP | 2002225854 | A | 8/2002 |
| JP | 2002240868 | A | 8/2002 |
| JP | 3095583 | U | 8/2003 |
| JP | 2004067209 | A | 3/2004 |
| JP | 2005329971 | A | 12/2005 |
| JP | 2008230670 | A | 10/2008 |
| JP | 2013124112 | A | 6/2013 |
| JP | 2013193782 | A | 9/2013 |
| JP | 5923220 | B2 | 5/2016 |
| WO | 2012154763 | A2 | 11/2012 |
| WO | 2013169260 | A1 | 11/2013 |
| WO | 2013169781 | A2 | 11/2013 |

* cited by examiner

PACKING BOX

CROSS REFERENCE TO RELATED APPLICATIONS

This application claims the benefit of and priority to PCT/JP2015/052001, filed on Jan. 26, 2015, entitled (translation), "PACKING BOX," which claims the benefit of and priority to Japanese Patent Application No. 2014-026283, flied on Feb. 14, 2014, all of which are hereby incorporated by reference in their entirety into this application.

BACKGROUND

Field of the Invention

Embodiments of the invention relate to a packing box including an upper cover and a lower box that are formed by cardboard, and to a packing box that is configured to contain, for example, a film of a width of about 0.5 to 2 meters that is wound around a longitudinal core, i.e., a film roll. According to at least one embodiment, the film is stuck to a glass window or other surfaces mainly by hand, and examples of the film include a shatterproof film, a thermal insulation film, and a UV-cutting film. At a construction site or the like, these films are cut into a desired width and length by hand to be stuck to a glass window or other surfaces, after the packing box is opened.

Description of the Related Art

Unfortunately, such a cardboard-made packing box has a low strength, and is long particularly in a longitudinal direction, so that it is easily bent at around its middle portion. In addition, such a packing box accommodating a film roll is easily bent when the packing box is placed on a pallet for transportation and it sticks out from the pallet. That is, a packing box that is long in the longitudinal direction sometimes concentrates weight at end portions of the box, and when a corner of the pallet hits the packing box at a portion other than the end portions, the packing box is pressed at the portion to be easily bent. The packing box is also easily bent when it is stacked into two or more tiers and the stacked packing boxes are shifted to each other.

Moreover, because such a packing box is long in the longitudinal direction, it is less workable and painstaking for one worker to remove the upper cover after opening the box.

Furthermore, in taking out a film in desired width and length from the film roll, the worker needs to measure the length with a measure or other tools and then position a cutter for cutting the film every time, which is also less workable and painstaking. Also, a cut surface of the cardboard which is formed by cutting the cardboard during the manufacture of the packing box is exposed, thereby easily scattering paper dust particles. The paper dust particles adhere to the film due to static electricity, further reducing the workability.

SUMMARY

Embodiments of the invention provide a packing box configured to accommodate an article therein, the packing box including an upper cover and a lower box that are formed by cardboard, the upper cover including a top board covering the entire interior of the lower box, and side boards extending, vertically downward from the respective sides of the top board and substantially covering side surfaces of the lower box, the top board having at least one pair of perforated portions at locations point-symmetrical to each other about the center of gravity of the top board, the perforated portions being configured to be bendable.

According to at least one embodiment, there is provided a packing box configured to accommodate an article therein, the packing box including an upper cover formed by cardboard and a lower box formed by cardboard. The upper cover includes a top board covering the entire interior of the lower box, and side boards extending vertically downward from the respective sides of the top board and substantially covering side surfaces of the lower box. The top board has at least one pair of perforated portions at locations point-symmetrical to each other about the center of gravity of the top board. The perforated portions are configured to be bendable.

According to at least one embodiment, the perforated portions are bent, a worker can lift the upper cover with a finger(s) in the holes. Embodiments of the invention improve work efficiency of opening the packing box. The holes formed at the perforated portions operate not only for the worker to place the finger(s), but also as air holes, thereby allowing the worker to open the box more easily. The packing box according to at least one embodiment is configured such that the perforated portions are bendable into the lower box. Accordingly, the worker can lift the upper cover using the holes formed and open the box without being bothered by the protruding portions formed by bending the perforated portions.

The packing box according to at least one embodiment is configured such that when bent, the perforated portions each has a portion that curves outward from a surface of the top board of the upper cover.

According to at least one embodiment, the bent portions are spaced outward from the center inside the lower box, and thus the bent portions avoid contact with a film roll contained in the box, allowing the content to be safely handled.

According to at least one embodiment, the packing box may be configured such that the upper cover further includes a pair of notches at a lower edge of each of the side boards in a longitudinal direction of the upper cover such that each pair of the notches is separated from the respective end portions by an equal distance.

According to at least one embodiment, when two workers stand at both end portions of the packing box and place their hands at the upper cover to open the box, the workers can place their hands at the notches, thereby improving work efficiency of opening the box. The notches may be formed in a variety of shapes, including one having a portion inclined upward at a predetermined angle from close to the center in the longitudinal direction and an arc portion continuous with the inclined portion. Provision of at least one notch can improve efficiency of opening the box. In this way, the packing box is configured considering the work at a site where the workers often work individually. Such a configuration that is provided with at least one notch can reduce manufacturing costs of the upper cover.

According to at least one embodiment, the packing box may be configured such that the lower box is provided with a graduation at an upper side of a longitudinal side board of the lower box, the graduation indicating lengths along the longitudinal direction.

According to at least one embodiment, in cutting the film while pulling out it from a film roll accommodated inside the box, the worker can grasp the desired width and easily determine the cutter position.

The packing box according to at least one embodiment may be configured such that at least longitudinal upper edges of the lower box are formed by folding back the cardboard.

According to at least one embodiment, the longitudinal strength of the lower box can be improved, and cut surface of the cardboard is not exposed to inhibit scattering of paper dust particles. In addition, in taking out the film from the film roll, the film moves smoothly on the upper edges, thereby improving efficiency of taking out the film.

According to at least one embodiment, a packing box that is formed by cardboard and is long in the longitudinal direction can be improved in strength. Embodiments of the invention improve work efficiency of a worker opening the box. Further, the present invention can improve efficiency of taking out a film from a film roll to be contained in the box to inhibit scattering of paper dust particles from the material, cardboard. In addition, a desired length of a film to be taken out can be determined easily, improving efficiency of taking out the film.

BRIEF DESCRIPTION OF DRAWINGS

These and other features, aspects, and advantages of the invention are better understood with regard to the following Detailed Description, appended Claims, and accompanying Figures. It is to be noted, however, that the Figures illustrate only various embodiments of the invention and are therefore not to be considered limiting of the invention's scope as it may include other effective embodiments as well.

DETAILED DESCRIPTION

Advantages and features of the invention and methods of accomplishing the same will be apparent by referring to embodiments described below in detail in connection with the accompanying drawings. However, the invention is not limited to the embodiments disclosed below and may be implemented in various different forms. The embodiments are provided only for completing the disclosure of the invention and for fully representing the scope of the invention to those skilled in the art.

Figure 1A:
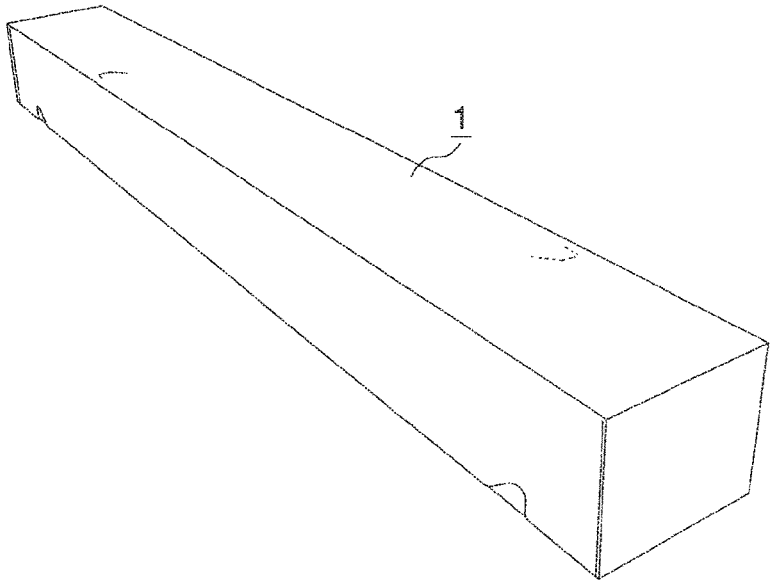
FIG. 1A is a perspective view of a packing box according to a embodiment of the invention.

FIG. 1A is an overall perspective view of an example packing box 1 in use according to an embodiment of the invention that is made of cardboard.

Figure 1B:
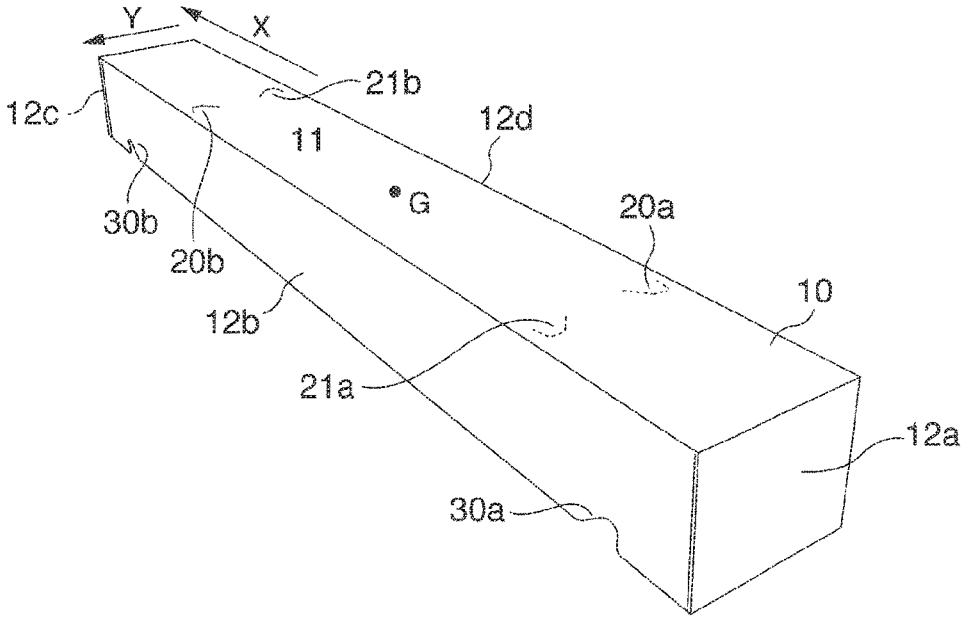
FIG. 1B is a perspective view of an upper cover of the packing box according to an embodiment of the invention.
Figure 1C:
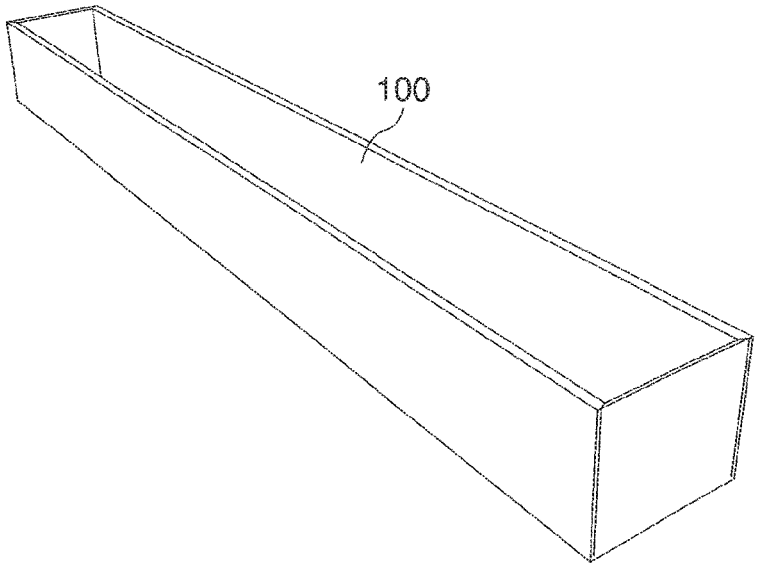
FIG. 1C is a perspective view of a lower box of the packing box according to an embodiment of the invention.

FIGS. 1B and 1C are, respectively, perspective views of an example upper cover 10 and an example lower box 100 that form the packing box 1. According to at least one embodiment, the upper cover 10 includes a rectangular top board 11 that has longer sides extending in a longitudinal direction X and shorter sides extending perpendicular to the longer sides, in a shorter-side direction Y. The top board 11 is provided with side boards 12*a*, 12*b*, 12*c*, and 12*d* extending vertically downward from the respective sides and each substantially covering the corresponding side surface of the lower box 100.

According to at least one embodiment, the top board 11 is provided with a pair of perforated portions 20*a* and 20*b* at locations point-symmetrical to each other about the center of gravity G of the upper cover 10. In opening the packing box 1 by oneself, a worker presses the perforated portions 20*a* and 20*b* to bend them into the box, place a finger(s) in the hole thus made, and lift the upper cover 10. At this time, the hole operates not only for placing the worker's finger(s) but also as an air hole, thereby further improving the efficiency of opening the box. The perforated portions may be configured to be bent outward.

Considering the work of opening the box, it is contemplated that the perforated portions 20*a* and 20*b* will be positioned to be point-symmetrical to each other about the center of gravity G, as in FIG. 1B. It is known that, generally, it is effective in such an opening work that the perforated portion corresponding to the worker's dominant arm, which is often the right arm, is farther than the one corresponding to the other arm. Thus, another pair of perforated portions 21*a* and 21*b* may also be provided. In this way, the worker may be at any working position relative to the packing box. The perforated portions may have any shapes as long as holes made by bending the perforated portions are as large as to receive one or two fingers. Each perforated portion, however, desirably has an arc-shaped periphery without a corner, because a corner in the perforated portion might cause a problem like easily breaking the cardboard from the corner. The positions of the perforated portions are not limited to those shown in FIG. 1B, and the perforated portions may be provided at any positions irrelevant to the center of gravity G. Also, the number of the perforated portions may be set appropriately, considering the work and convenience of the worker. The perforated, portions are not necessarily configured to be bent, and they may be configured to be removed. Moreover, a hole may be simply provided that can receive the worker's finger(s) at the location of each perforated portion, instead of the perforated portion. The perforated portions will be described later in detail.

Figure 1D:
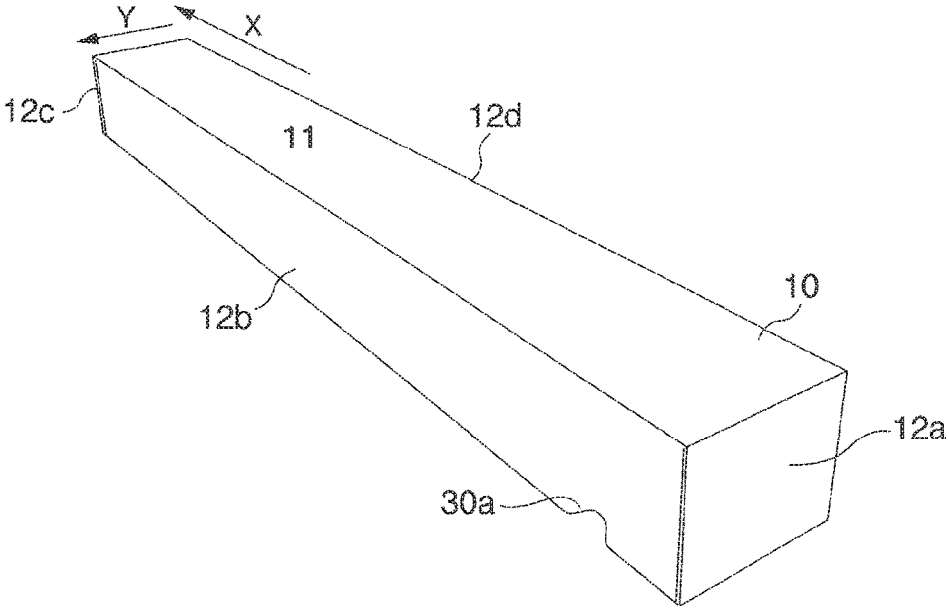
FIG. 1D is a perspective view of a modification of the upper cover of the packing box according to an embodiment of the invention.

According to at least one embodiment, the upper cover 10 is provided with notches 30*a* and 30*b* on both side boards 12*b* and 12*d* formed along longer sides of the upper cover 10. On each of the side boards, the notches 30*a* and 30*b* are formed at a predetermined distance from respective end portions of the side board. This configuration improves work efficiency, for two workers standing on the opposite end portions, of placing their hands at the upper covers and lifting the upper covers to open the box. The positions and the shape of the cuts are determined appropriately, but the cuts are positioned at an equal distance from the respective end portions. It is desirable that each cut be gene ally as large as a palm. The notch is basically formed in a triangle whose base aligned with a lower edge of the side board, and the triangle may be deformed appropriately. As an example, the notch may have a portion inclined at a predetermined angle from the center toward the end portion and an arc continuous with the inclined portion, as shown in FIG. 1B. The upper cover 10 may be provided with the notch 30*a* on only one of the side boards, close to one end surface, as shown in FIG. 1D. The provision of the only one notch can sufficiently improve work efficiency, considering that workers often work individually at a site, and also reduces the manufacturing cost of the upper cover. It is desirable that the notch be formed to have no corners, similarly to the perforated portions. The notch will also be described later in detail.

Figure 2A:
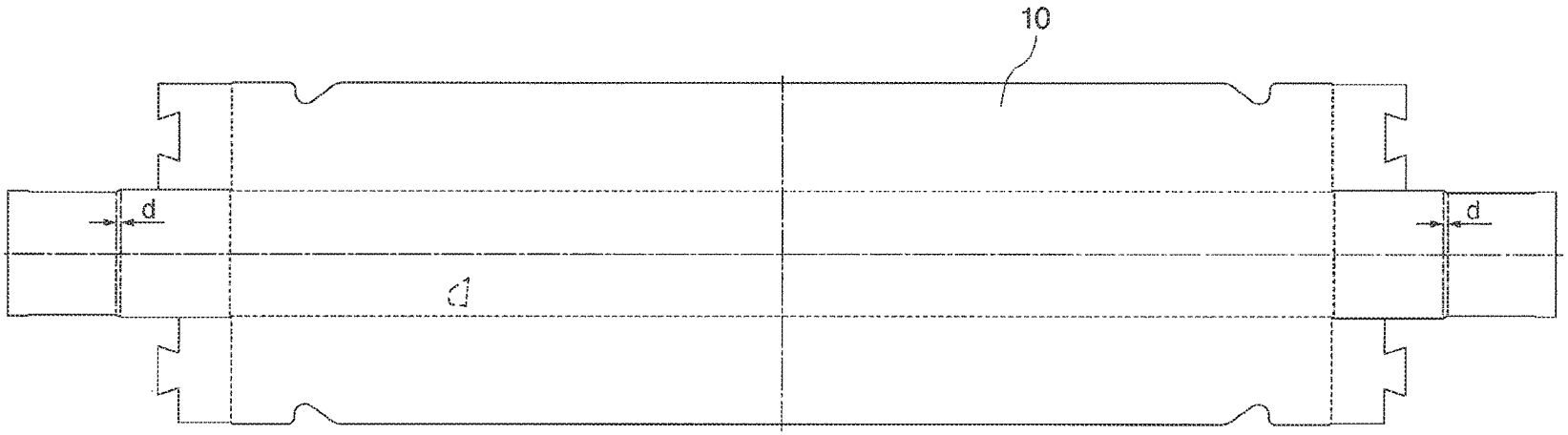
FIG. 2A is a developed view of the upper cover according to an embodiment of the invention.
Figure 2B:
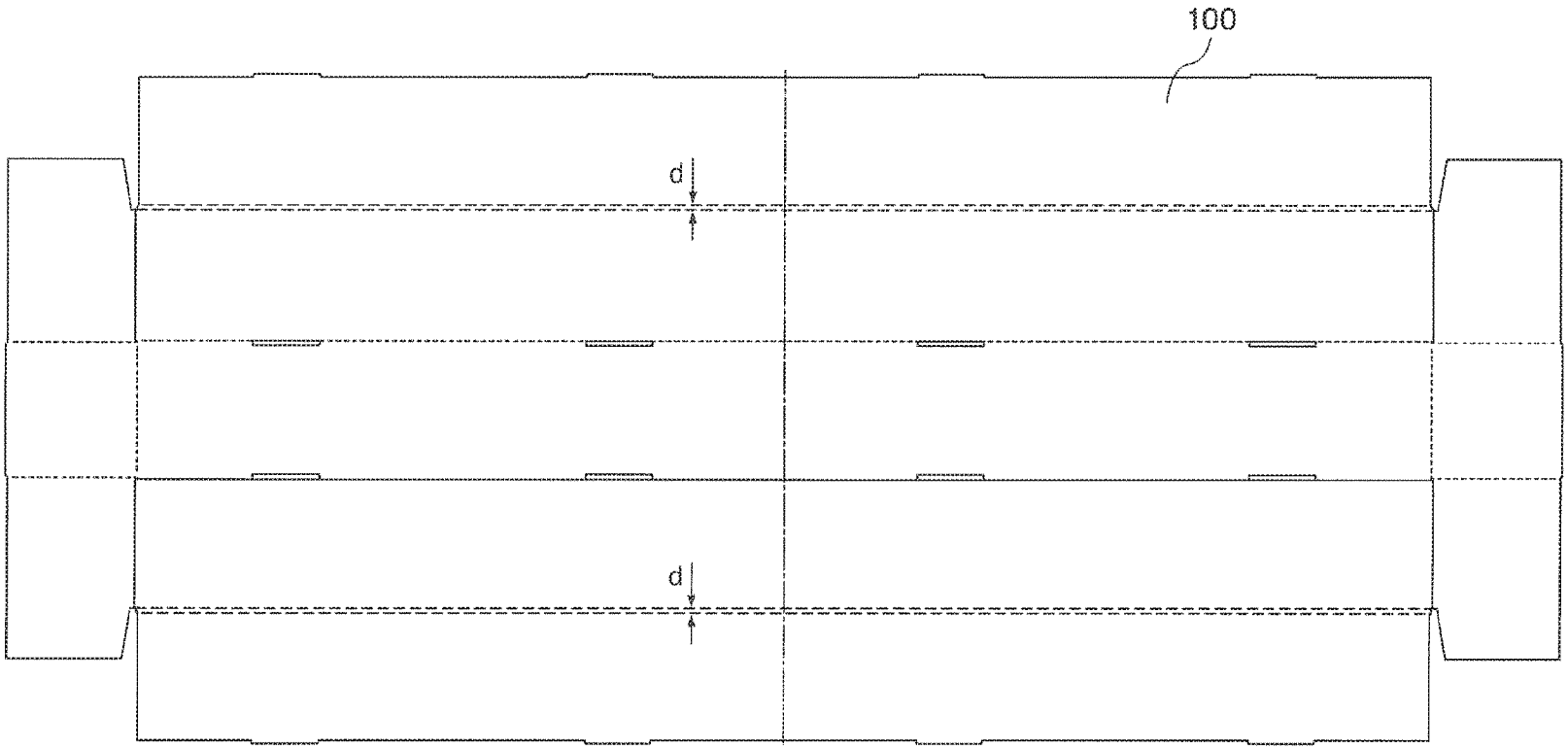
FIG. 2B is a developed view of the lower box according to an embodiment of the invention.

FIGS. 2A and 2B are developed views of the upper cover 10 and the lower box 100, respectively. Both the upper cover 10 and the lower box 100 can be formed by bending a piece of cardboard. As shown by a portion d in FIG. 2A, shorter sides of the upper cover 10 are formed by folding hack the cardboard. Also, as shown by a portion d in FIG. 2B, longer sides of the lower box 100 are formed by folding hack the cardboard. Because of the configuration, both the upper cover and the lower box can be improved in structural strength. In particular, the lower box 100 is improved in strength in the longitudinal direction. This avoids problems like bending of the lower box at the middle portion when accommodating a heavy object, or inhibits a depression due to an external impact or a depression that would be formed at the middle portion when the packing box is lifted. Further, the improved strength allows mounting of a cutter on a side surface of the lower box that will be described later. In addition, adoption of such a fold-back configuration prevents exposure of the cut surface of the cardboard to inhibit scattering of paper dust particles from the cardboard. The paper dust particles easily adhere to the film due to static electricity, and thus the inhibition of the scattering of them significantly improves the work efficiency. Moreover, the longer sides of the lower box are each formed by a surface of the cardboard, allowing the worker to smoothly take out the film contained. Such graduation can be provided even if the packing box is configured to have only one notch, like in FIG. 1D.

Figure 3A:
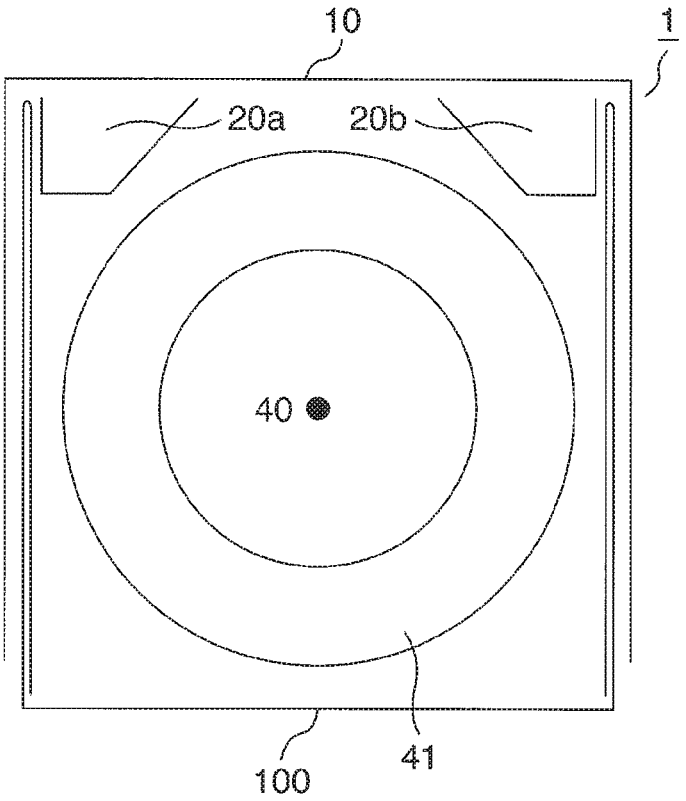
FIG. 3A is a cross-sectional view of the packing box according to an embodiment of the invention illustrating the packing box accommodating a content, a film roll.
Figure 3B:
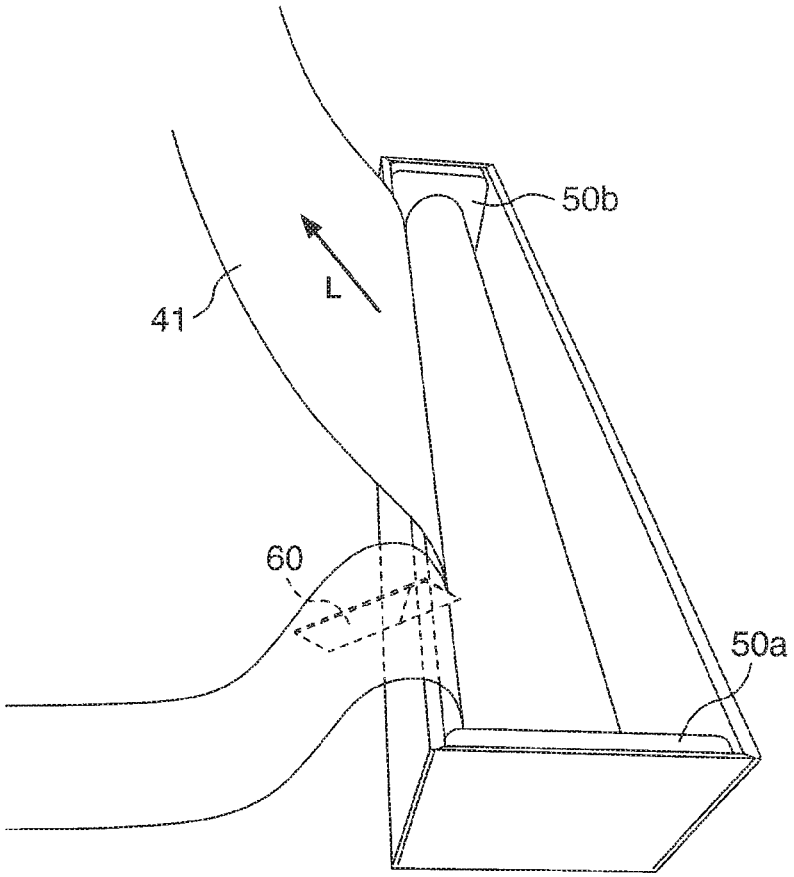
FIG. 3B is a perspective view of the packing box illustrating a film being taken out from the film roll accommodated in the box according to an embodiment of the invention.

FIG. 3A is a cross-sectional view of the packing box 1 in use, illustrating the packing box 1 accommodating the content, the film roll 40 and 41. FIG. 3B is a perspective view of the packing box 1 illustrating the content being taken out. The film roll 40 and 41 is a film 41 wound around a core 40 of a predetermined diameter and is supported by a pair of core holders/protectors 50*a* and 50*b* that are provided at both ends in the lower box 100. As shown in FIG. 3A, the perforated portions 20*a* and 20*b* are desirably shaped such that they will not contact the film 41 when bent to protrude into the lower box 100. The film 41 is to be stuck to a glass window or other surfaces by hand and examples of the film 41 include a so called shatterproof film, a thermal insulation film, and a UV-cutting film. As shown in FIG. 3B, the film 41 is taken out in a direction shown by a character L or other directions at, for example, a construction site, and cut in desired width and length, before stuck to a window or other surfaces. A cutter 60 may be configured such that it is fixed at a side surface of the lower box 100 by piercing the side surface with the cutter 60 and mounting the cutter 60, and cuts the film 41 as the film 41 is taken out, thereby providing a film of a desired width.

Figure 4:
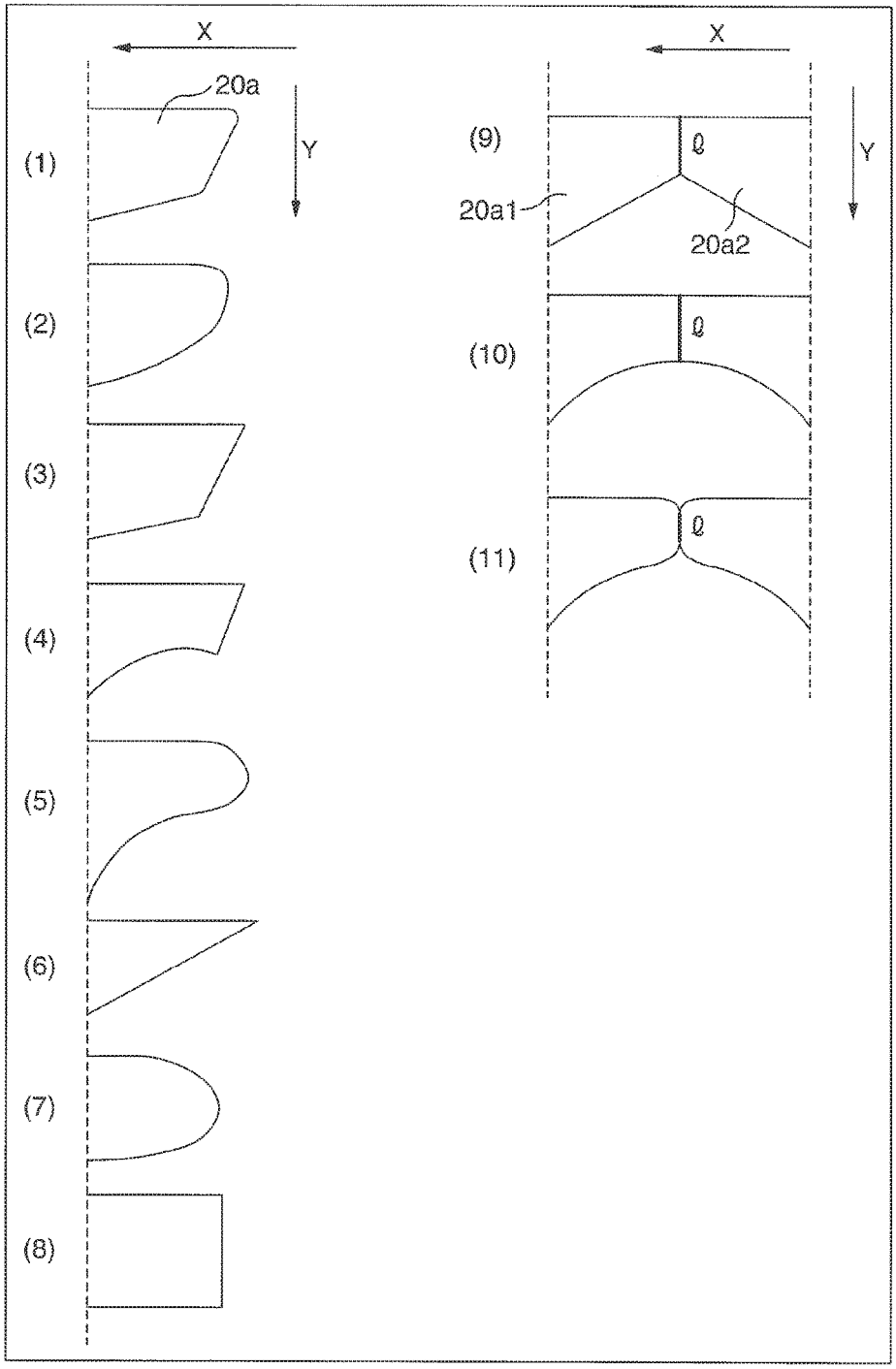
FIG. 4 is a plan view of example configurations of a perforated portion provided on the upper cover according to an embodiment of the invention.

FIG. 4 is a plan view of example perforated portions 20*a*. It is desirable that the perforated portions be shaped not to contact the surface of the accommodated film and become spaced outward from the central line of the packing box, when the perforated portions are bent to protrude into the box. Specifically, as shown in (1), (3), and (6) in FIG. 4, the perforated portions may each have a side inclined outwardly from the central line of the top board, so that the inclination inhibits the contact with the film. As shown in (2), (4), and (5) in FIG. 4, the perforated portions may each have a portion that curves outwardly from the central line, so that the curved portion inhibits the contact with the film. Desirably, these shapes have as few corner portions as possible. It is possible that the perforated portions and the film will not contact with each other even if the perforated portions protrude, depending on the size of the film roll contained. In that case, the perforated portions may be shaped like those in (7) or (8) in FIG. 4, and there is no need to consider spacing the perforated portions outward relative to the packing box. Cardboard processing costs for manufacturing the upper cover can be reduced by forming the perforated portions in a shape without any corners like in (7) or a simple shape like in (8). The perforated portions formed in shapes like in (2), (5), and (7), each of which has no corner and is rounded entirely, are punched clearly into the box when pressed by a finger(s) in starting the work, or is not broken at the bent portion when bent outwardly, making the worker more comfortable with the work.

According to at least one embodiment, perforated portions shown in (9) to (11) of FIG. 4, each has a cut 1 at the center of the perforated portion and has a pair of bending pieces 20*a*1 and 20*a*2 that are separated from the cut to protrude into the lower box as they are pressed by the worker's finger(s). Such a configuration allows the worker to make a hole at the perforated portion with less force, and also, can improve the work efficiency. Additionally, with such a configuration, only a desired one of the pair of bending portions can be bent or both of the pair of bending portions can be bent toward the respective sides, and thus, the configuration flexibly meets the work.

Figure 5:
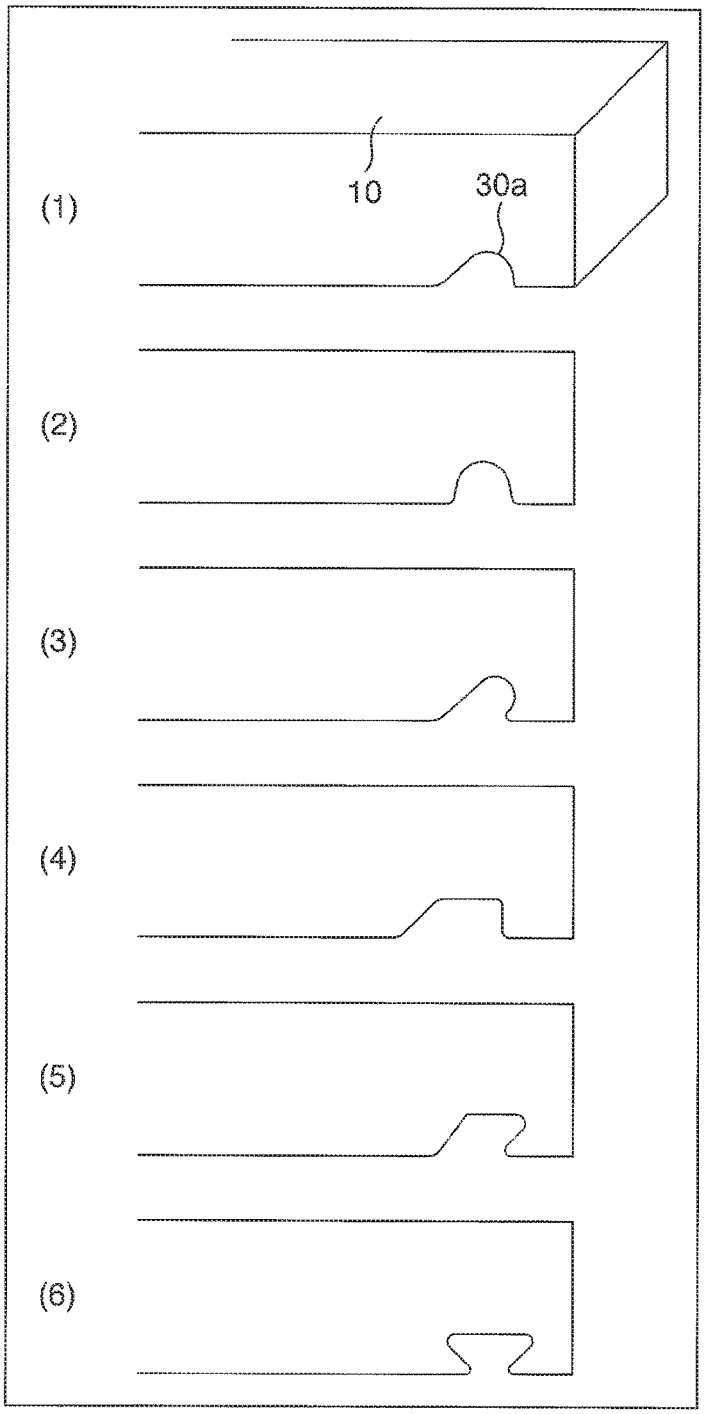
FIG. 5 is a perspective view of example configurations of a notch provided at a longitudinal lower edge of a side board of the upper cover according to an embodiment of the invention.

FIG. 5 is a perspective view of example notches 30*a* each of which is provided at the lower edge of the side board of the upper cover 10. The shape, positions, and number of the notches may be set appropriately. The notches are, however, intended for two workers standing at the opposite ends of the packing box for opening the box to lift the upper cover in cooperation with each other. Accordingly, it is desirable that the notches be provided on opposite side boards and that the notches on each side board be at an equal distance from the respective sides. It is also desirable that each cut be generally as large as a palm, so that the workers can easily place their hands. With this configuration, each worker moves their finger(s) along the linear portion, position the finger inside the arc portion, and open the box.

In FIG. 5, (1) shows a notch 30*a* having a linear portion inclined from the center of the packing box toward the end portion and an are portion continuous with the linear portion. The angle of the inclined portion may be optimally set in accordance with the length of the longer sides of the upper cover, the physiques of the workers, or other factors. For example, the inclined portion is preferably inclined at an angle of 25 degrees to 40 degrees relative to the lower side, and more preferably in the range of from 30 degrees to 36 degrees. The provision of the inclined portion allows the finger to smoothly move from the center of the packing box toward the end portion and easily fit into the arc portion.

A portion of the arc portion close to the lower edge may protrude further toward the center as shown in (3) in FIG. 5. In this way, the workers can stably hold the end portion of the upper cover with their fingers each placed on an upper surface of the protruding portion to be fixed.

In FIG. 5, (2) shows a notch that is formed at the lower edge of the side board, in a semi-circular shape having a diameter of the length of the notch. With such a configuration, the workers fingers that fit inside the notches 30*a* are stabilized and the workers can stably hold the end portions of the upper cover.

In FIG. 5, (4) to (6) each shows a notch whose upper surface is formed in a flat portion. This configuration improves flexibility in the position of the worker's finger inside the notch. In particular, the configuration sufficiently accommodates different sizes of the workers' palms. Such a configuration is effective because of the fact that the content of the packing box, a film roll, which is in high demand both domestically and in foreign countries, is treated by workers of a variety of races with non-uniform physiques.

Figure 6A:
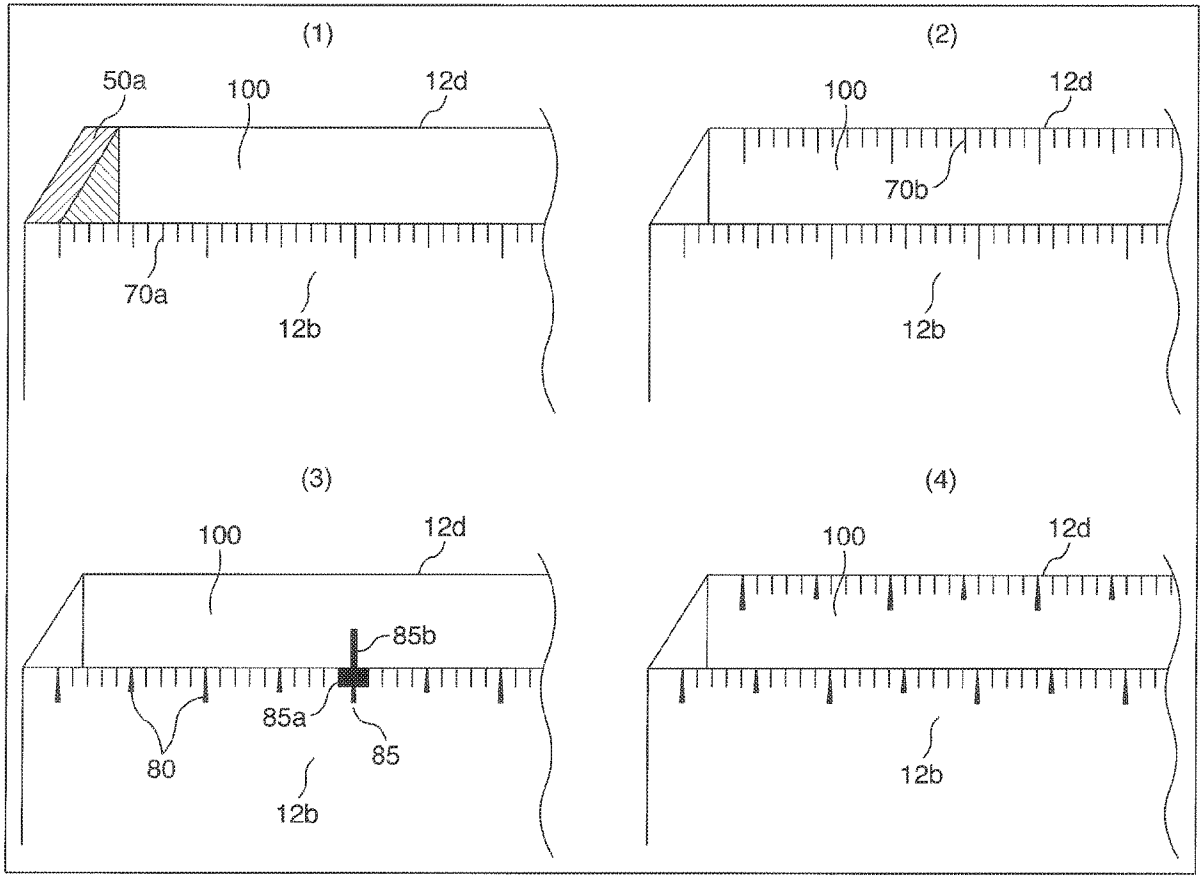
FIG. 6A is a perspective view of example configurations of graduation provided on a side surface of the lower box according to an embodiment of the invention.

FIG. 6A is a perspective view of example lower boxes 100 having graduations 70*a* and 70*b* indicating a length, at a longitudinal upper edge of the lower box 100. In this way, in taking out the film 41 from the packing box and cutting the film 41 at a desired position along the longitudinal direction of the lower box 100, that is, the transverse direction of the film 41, the positions can be determined accurately and quickly. Such a graduation can be provided at a packing box that is configured to have only one notch like the one in FIG. 1*d*.

In FIG. 6A, (1) shows an example lower box that is graduated at a longitudinal upper edge of a side board at predetermined intervals. The origin of the graduation may be marked considering the thickness of the core holder/protector 50*a* in advance. In this case, the graduation may be provided not only at the side board 12*b*, but also on the side board 12*d* opposite to the side board 12*b* so as to make the work more efficient, based on the working procedure in opening the packing box.

In FIG. 6A, (2) shows an example lower box that additionally has a graduation 70*b* on the back of each of the side boards. It is probable that the worker needs to grasp the longitudinal length of the film within the inside of the packing box, depending on the working, procedure. The provision of the graduation on the back of each side board is effective in such a case. Further, when the worker mounts the cutter 60 as in FIG. 3*b*, the provision of the graduation on both sides of the side board makes it easy to mount the cutter 60 such that the cutter 60 is oriented precisely perpendicular to the surface of the side board. In such mounting of the cutter, a graduated unit and a display position of the graduation on the front is desirably aligned with those on the back. The graduated unit, however, is not necessarily the same in the front and the back and may be set appropriately in accordance with the necessity in the work. For example, the front and the back may be graduated differently, like in centimeters on the front and in inches on the back.

In FIG. 6A, (3) shows an example lower box having a graduation that is marked differently at portions 80 positioned at predetermined intervals than other portions. The interval may be determined appropriately in accordance with the necessity in the working procedure, such as 5 centimeters or 1.0 centimeters. With such a configuration, the worker can easily grasp the length of the film in the longitudinal direction, and quickly and reliably mount a slitting blade 85 that is used for cutting the film in a desired width while taking out the film, thereby improving the work efficiency. The slitting blade 85 may include a clip portion 85*a* for mounting the slitting blade 85 on the upper edge of the lower box and a blade portion 85*b*, for example. The blade portion 85*b* may be formed like a pin, depending on the material of the film.

One having a clip-shaped body that can be mounted on the upper edge of the lower box 100 and a blade provided upward on the clip-shaped body is suitably used as the slitting blade 85. With a slitting blade of such a configuration, the worker can cut the film while taking out the film.

In FIG. 6A, (4) shows a lower box 100 having such a graduation that includes special indications provided at predetermined intervals, also on the inside of the lower box 100.

Figure 6B:
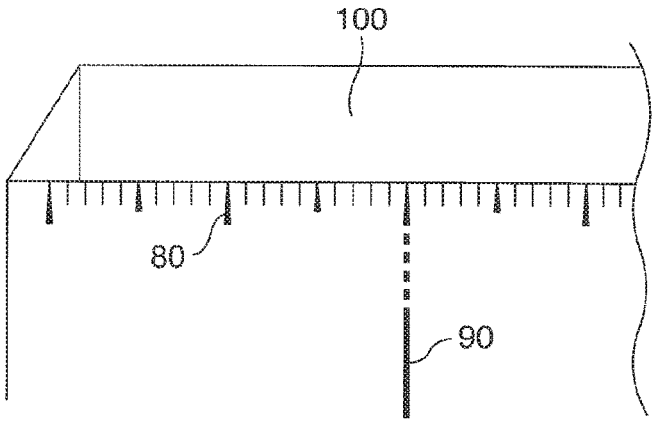
FIG. 6B is a perspective view of a modification where a slit is further provided in addition to the graduation according to an embodiment of the invention.

FIG. 6B shows a lower box having a slit 90 at a predetermined position of the graduation 80. It can be more convenient to cut the taken out film while pulling the film downward than to cut the film over the lower box 100, depending on the material of the film. In such a case, it is advantageous in terms of work efficiency to mount the cutter 60 on the side board of the lower box 100 as shown in FIG. 3*b*. The advance provision of the slit 90 for attaching the cutter 60 improves work efficiency.

The packing box has been described that has a rectangular top board and is made of cardboard as shown in FIG. 1A as an embodiment of the invention, white embodiments of the invention are not limited to such an embodiment.

Figure 7:
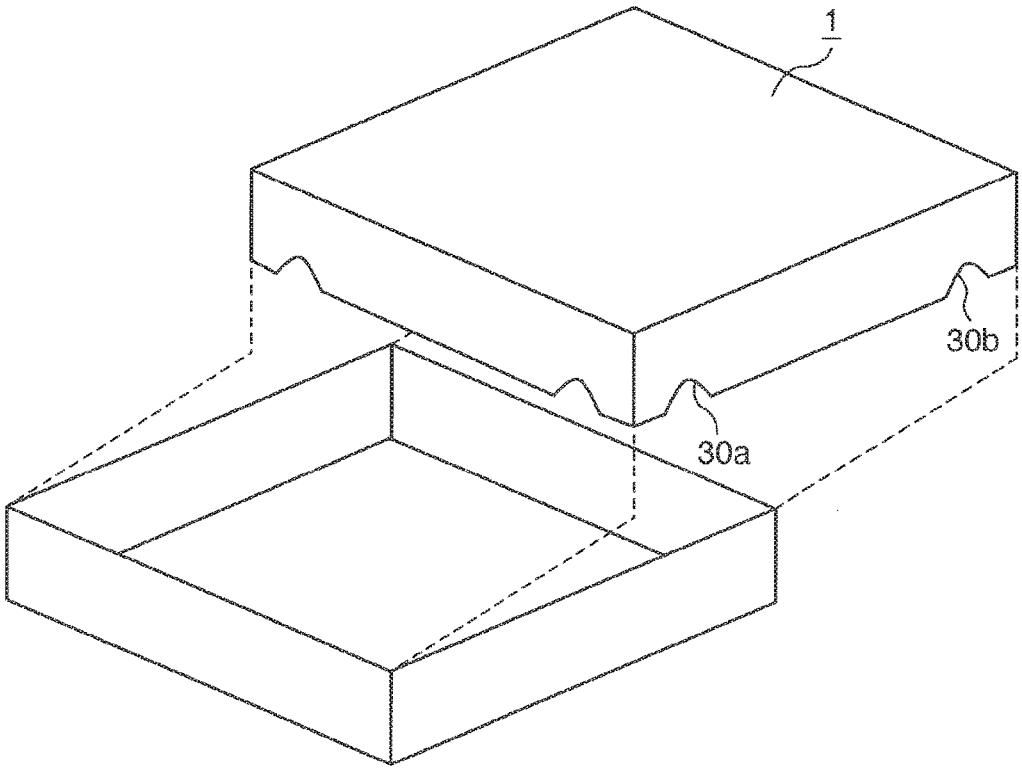
FIG. 7 is a perspective view of a packing box according to another embodiment of the invention.
Figure 8:
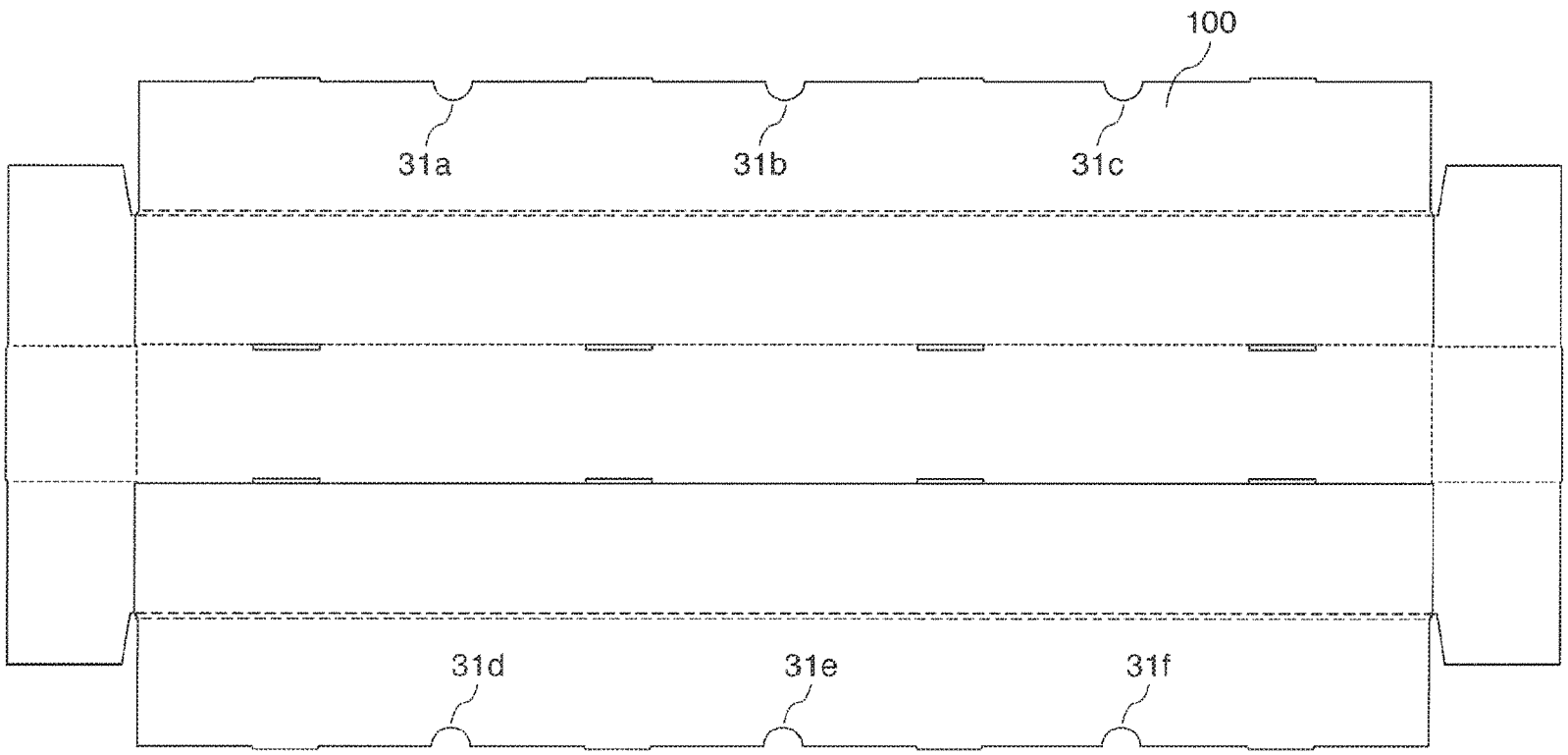
FIG. 8 is a developed view showing yet another embodiment of the lower box of the packing box of the invention.
Figure 9:
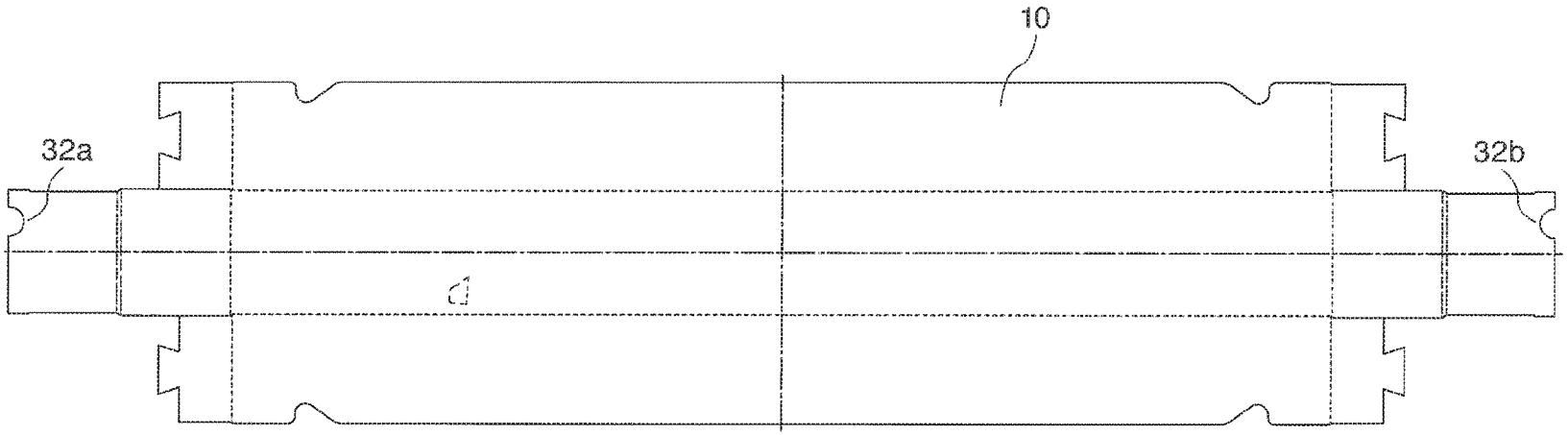
FIG. 9 is a developed view showing yet another embodiment of the upper cover of the packing box of the invention.

For example, when the content of the box is not a film roll hut in the form of cut-sheet paper of about 0.5 to 2 meters long and about 0.5 to 2 meters wide, an almost square box as shown in FIG. 7 is used. Such a packing box can also be provided with notches 30*a* and 30*b* as appropriate at a lower edge of an upper cover to improve work efficiency. A top board of the upper cover may have a perforated portion or a hole. Further, in order to make it easy to unfold the packing box after use, arc-shaped or semi-circular notches 31*a* to 31*f*, 32*a*, and 32*b* may be provided at tip edges of the fold-back flaps formed at the upper cover shorter sides or at tip edges of the fold-back flaps formed at the lower box longer sides to allow the worker to place a finger(s) at the notches, as shown in FIGS. 8 and 9. The shape and the number of these notches may be set appropriately, considering the size, strength, and shape of the entire box, and ease of placing a finger(s). It is contemplated that the notches are formed in an almost semi-circular shape or an almost U-shape of a size to receive about one to two fingers.

The configuration according to an embodiment of the invention has been described in detail, while the above description is intended merely to illustrate the invention, and those who have ordinary knowledge in the technical field to which the present invention belongs can make various modifications without departing from the essential characteristics of the invention. For example, embodiments of the invention can be configured as follows:

(1) a packing box configured to accommodate an article therein, the packing box including an upper cover and a lower box that are formed by cardboard, the upper cover including a top board covering the entire interior of the lower box, and side boards extending vertically downward from the respective sides of the top board and substantially covering side surfaces of the lower box, the top board having at least one pair of perforated portions at locations point-symmetrical to each other about the center of gravity of the top board, the perforated portions being configured to be bendable.

(2) the packing box according to the item (1), in which the perforated portions are configured to be bendable into the lower box.

(3) the packing box according to the item (1) or (2), in which when the perforated portions are bent into the lower box, the bent portions become spaced from the central line of the top board.

(4) the packing box according to any one of the items (1) to (3); in which the bent portions of the perforated portions each have a line inclined outwardly from the central line of the top board.

(5) the packing box according to any one of the items (1) to (3), in which the bent portions of the perforated portions each have a portion that curves outwardly from the central line of the top board.

(6) the packing box according to any one of the items (1) to (5), in which the perforated portions each have a cut that is perpendicular to a longitudinal direction of the upper cover, and a pair of bending, pieces configured to be separated from the cut and protrude into the lower box when bent.

(7) the packing box according to any one of the items (1) to (6), in which the upper cover is provided with at least one notch at a lower edge of a side board in a longitudinal direction of the upper cover.

(8) the packing box according to the items (1) to (6), in which the upper cover is provided with a pair of the notches at lower sides of both side boards in the longitudinal direction, at an equal distance from the respective ends.

(9) the packing box according to any one of the items (1) to (8), in which each of the notches has a flat portion that is parallel with the lower side.

(10) the packing box according to any one of the items (1) to (9), in which each of the notches has a linear part inclined vertically upward at a predetermined angle toward the corresponding end and an arc part continuous with the linear part.

(11) the packing box according to any one of the items (1) to (10), in which the predetermined angle is in a range of from 25 degrees to 40 degrees.

(12) the packing box according to the items (1) to (11), in which each of the notches has a semi-circular shape having a diameter of the length of the notch.

(13) the packing box according to any one of the items (1) to (12), in which a flat portion is provided at an upper part of each of the notches.

(14) the packing box according to any one of the items (1) to (13), in which the lower box has a graduation at an upper side of a side board in a longitudinal direction, the graduation indicating a length in the longitudinal direction.

(15) the packing box according to any one of the items (1) to (14), in which the graduation is provided on both side boards in the longitudinal direction.

(16) the packing box according to any one of the items (1) to (14), in which the graduation is marked differently once every predetermined number of divisions, than other marks.

(17) the packing box according to any one of the items (1) to (16), in which the graduation is provided both on a front and a back of the side board.

(18) the packing box according to any one of the items (1) to (17), in which the lower box is further provided with a slit at a portion of the graduation provided with a division mark.

(19) the packing box according to any one of the items (1) to (18), in which at least longitudinal upper edges of the lower box are formed by folding back the cardboard.

Terms used herein are provided to explain embodiments, not limiting the invention. Throughout this specification, the singular form includes the plural form unless the context clearly indicates otherwise. When terms "comprises" and/or "comprising" used herein do not preclude existence and addition of another component, step, operation and/or device, in addition to the above-mentioned component, step, operation and/or device.

Embodiments of the invention may suitably comprise, consist or consist essentially of the elements disclosed and may be practiced in the absence of an element not disclosed. According to at least one embodiment, it can be recognized by those skilled in the art that certain steps can be combined into a single step.

The terms and words used in the specification and claims should not be interpreted as being limited to typical meanings or dictionary definitions, but should be interpreted as having meanings and concepts relevant to the technical scope of the invention based on the rule according to which an inventor can appropriately define the concept of the term to describe the best method he or she knows for carrying out the invention.

The singular forms "a," "an," and "the" include plural referents, unless the context clearly dictates otherwise.

As used herein and in the appended claims, the words "comprise," "has," and "include" and all grammatical variations thereof are each intended to have an open, non-limiting meaning that does not exclude additional elements or steps.

Occurrences of the phrase "according to an embodiment" herein do not necessarily all refer to the same embodiment.

Therefore, the embodiments disclosed herein are not intended to limit the present invention but to describe the embodiments of the invention, and the embodiments will not limit the spirit and scope of the embodiments of the invention. The scope of the embodiments of the invention should be interpreted from the appended claims, and all techniques within the range of equivalency should be interpreted as being included in the scope of the embodiments of the invention.

REFERENCE SIGNS LIST

1 Packing box
10 Upper cover
11 Top board
12*a* to 12*d* Side board
20*a*, 20*b* Perforated portion
30*a*, 30*b* Notch
100 Lower box
40, 41 Film roll
50*a*, 50*b* Core holder/protector
60 Cutter
70*a*, 70*b*, 80 Graduation
85 Slitting blade
85*a* Clip portion
85*b* Blade portion
90 Slit

The invention claimed is:

1. A packing box configured to accommodate an article therein, the packing box comprising:

an upper cover formed by cardboard; and a lower box formed by cardboard, wherein the upper cover comprises a top board covering an entire interior of the lower box, and side boards extending vertically downward from respective sides of the top board and substantially covering side surfaces of the lower box, and wherein the upper cover has at least one notch for opening the upper cover at lower longitudinal edges of the side boards such that the notch is located off a center of the packing box in a longitudinal direction and separated from both end portions in the longitudinal direction by a predetermined distance, wherein each notch of the at least one notch has a linear part extending from a first portion of the lower longitudinal edge of the side board and inclined vertically upward at a predetermined angle toward the corresponding end portion and an arc part continuous with the linear part and extending and ending at a second portion of the lower longitudinal edge of the side board, the linear part and the arc part providing an asymmetrical configuration to each notch, wherein each notch is of a size large enough for at least one finger to be inserted thereinto to pull up the upper cover, and wherein, when the upper cover is engaged with the lower box such that the side boards extending vertically downward from the respective sides of the top board cover the entire side surfaces of the lower box, each notch provides an unfilled aperture exposing a portion of the side surfaces of the lower box.

2. The packing box according to claim 1, wherein the upper cover is provided with a pair of the notches at a lower edge of each of the side boards in a longitudinal direction of the upper cover such that each pair of the notches is separated from respective end portions by an equal distance.

3. The packing box according to claim 1, wherein each of the notches has a flat portion that is parallel with the lower edge.

4. The packing box according to claim 1, wherein the lower box is not provided with a notch at a position corresponding to the at least one notch.

5. The packing box according to claim 1, wherein the predetermined angle is in a range of from 25 degrees to 40 degrees.

6. The packing box according to claim 1, wherein longitudinal upper edges of the lower box have flaps formed by folding the cardboard back into the lower box, and tip edges of flaps are each provided with at least one notch.

7. The packing box according to claim 1, wherein transverse lower edges of the upper cover have flaps formed by folding the cardboard back into the upper cover, and tip edges of flaps are each provided with at least one notch.

8. The packing box according to claim 1, wherein the top board of the upper cover is provided with at least one perforated portion.

9. The packing box according to claim 8, wherein the perforated portion is configured to be bendable or removable.

10. The packing box according to claim 8, wherein at least a pair of perforated portions among the at least one perforated portion is provided at locations point-symmetrical to each other about a center of gravity of the top board.

11. The packing box according to claim 1, wherein the top board of the upper cover has at least one hole.

12. The packing box according to claim 1, wherein the lower box is provided with a graduation at an upper side of a side board in a longitudinal direction of the lower box, the graduation indicating lengths along the longitudinal direction.

* * * * *